US009291927B2

(12) United States Patent
Sandler et al.

(10) Patent No.: US 9,291,927 B2
(45) Date of Patent: Mar. 22, 2016

(54) METHOD AND APPARATUS FOR CONCENTRATING AN INK FOR AN ELECTROSTATIC PRINTING PROCESS

(75) Inventors: Mark Sandler, Nes Ziona (IL); Shai Lior, Nes Ziona (IL); Avner Schneider, Nes Ziona (IL); Eyal Bachar, Nes Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 14/238,826

(22) PCT Filed: Sep. 9, 2011

(86) PCT No.: PCT/EP2011/065635

§ 371 (c)(1),
(2), (4) Date: Feb. 13, 2014

(87) PCT Pub. No.: WO2013/034194

PCT Pub. Date: Mar. 14, 2013

(65) Prior Publication Data

US 2014/0199627 A1 Jul. 17, 2014

(51) Int. Cl.
*G03G 5/10* (2006.01)
*G03G 13/05* (2006.01)
(Continued)

(52) U.S. Cl.
CPC ..... *G03G 9/0815* (2013.01); *G03G 15/104* (2013.01)

(58) Field of Classification Search
CPC ..... G03G 15/02; G03G 15/0216; G03G 15/0208; G03G 15/751; G03G 15/757; G03G 2221/1606; G03G 2221/1693
USPC ..... 399/115, 117, 168
See application file for complete search history.

(56) References Cited

U.S. PATENT DOCUMENTS 3,863,603 A 2/1975 Buckley et al.
3,959,574 A 5/1976 Seanor et al.
(Continued)

FOREIGN PATENT DOCUMENTS

EP 0836943 4/1998
JP 11254698 9/1999
(Continued)

OTHER PUBLICATIONS

Larostat 264A Quaternary Ammonium Compound, Technical Bulletin, BASF Corporation, 2002.
(Continued)

*Primary Examiner* — Hoa V Le
(74) *Attorney, Agent, or Firm* — HP Inc. Patent Department

(57) ABSTRACT

The present application relates to a method for concentrating an ink for an electrostatic printing process, wherein the method comprises the steps of:

(a) providing the ink for an electrostatic printing process, the ink comprising chargeable particles in a liquid carrier;
(b) passing the ink between a chargeable conveyor and a first electrode, wherein a potential is applied such that the ink becomes adhered to the chargeable conveyor;
(c) passing the ink on the conveyor past a moving surface, wherein the ink contacts the moving surface and a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated ink on the conveyor, the conveyor and the moving surface then diverging from one another, such that substantially all of the concentrated ink remains on the conveyor;
(d) removing the concentrated ink from the conveyor and transferring it to a storage vessel. An apparatus for carrying out this method is also disclosed.

17 Claims, 2 Drawing Sheets

(51) Int. Cl.

| | |
|---|---|
| ***G03G 9/08*** | (2006.01) |
| ***G03G 15/10*** | (2006.01) |

(56) References Cited

U.S. PATENT DOCUMENTS

| | | | | |
|---|---|---|---|---|
| 4,286,039 | A | 8/1981 | Landa et al. | |
| 5,192,638 | A | 3/1993 | Landa et al. | |
| 5,332,642 | A * | 7/1994 | Simms et al. | 430/117.31 |
| 5,352,558 | A * | 10/1994 | Simms et al. | 430/117.31 |
| 5,436,706 | A | 7/1995 | Landa et al. | |
| 5,610,694 | A | 3/1997 | Lior et al. | |
| 5,737,666 | A | 4/1998 | Lior et al. | |
| 5,815,779 | A * | 9/1998 | Abramsohn | 399/249 |
| 6,070,042 | A | 5/2000 | Landa et al. | |
| 6,072,972 | A | 6/2000 | Obu et al. | |
| 6,183,931 | B1 | 2/2001 | Odell | |
| 6,337,168 | B1 | 1/2002 | Almog | |
| 6,621,998 | B2 | 9/2003 | Liu et al. | |
| 7,544,458 | B2 | 6/2009 | Iraqi et al. | |
| 2002/0090231 | A1 * | 7/2002 | Ooka et al. | 399/237 |
| 2010/0103437 | A1 | 4/2010 | Li | |
| 2010/0124662 | A1 * | 5/2010 | Moorlag et al. | 428/421 |

FOREIGN PATENT DOCUMENTS

| | | |
|---|---|---|
| WO | 2005054959 | 6/2005 |
| WO | 2007130069 | 11/2007 |
| WO | 2011001199 | 1/2011 |
| WO | 2011035811 | 3/2011 |

OTHER PUBLICATIONS

International Preliminary Report on Patentability dated Mar. 20, 2014 for PCT/EP2011/065635, Applicant Hewlett-Packard Indigo B.V. et al., Reference No. P117474PC00.

* cited by examiner

METHOD AND APPARATUS FOR CONCENTRATING AN INK FOR AN ELECTROSTATIC PRINTING PROCESS

BACKGROUND

In general, electrostatic printing processes involve creating an image on a photoconductive surface, applying an ink having charged particles to the photoconductive surface, such that they selectively bind to the image, and then transferring the charged particles in the form of the image to a print substrate.

Electrostatic printing systems will now be described in a little more detail. The photoconductive surface is typically on a cylinder and is often termed a photo imaging plate (PIP). The photoconductive surface is selectively charged with a latent electrostatic image having image and background areas with different potentials. For example, an electrostatic ink composition comprising charged toner particles in a liquid carrier can be brought into contact with the selectively charged photoconductive surface. The charged toner particles adhere to the image areas of the latent image while the background areas remain clean. The image is then transferred to a print substrate (e.g. paper) directly or, more commonly, by being first transferred to an intermediate transfer member, which can be a soft swelling blanket, and then to the print substrate. Variations of this method utilize different ways for forming the electrostatic latent image on a photoreceptor or on a dielectric material.

In some systems, the electrostatic ink composition is applied to the PIP by pumping the ink between a stationary electrode and the PIP. Such a system is illustrated in WO 2005/054959, which is incorporated herein by reference in its entirety. Other electrostatic printing systems include a binary ink development (BID) unit. In such a system, the ink is applied to the photoconductive surface by a developer roller. Often, a different developer roller is used for each different color ink (e.g. cyan, magenta, yellow and black). Ink is applied to the developer roller by passing an electrostatic ink composition between a stationary charged electrode and the developer roller. Ideally, the charged toner particles should form a uniform layer on the development roller. The developer roller rotates, such that the charged particles contact the PIP electrically. Such a system is illustrated in U.S. Pat. Nos. 5,436,706, 5,610,694 and 5,737,666, all of which are incorporated herein by reference in their entirety.

Typically, an electrostatic ink composition comprises a thermoplastic resin as the basis for the toner particles, and a non-polar liquid as a liquid carrier in which the toner particles are dispersed. Generally, the toner particles contain a colorant such as a pigment. A charge director, also called charge control agent or imaging agent, is also typically added to the dispersion to induce charge on the particles. The content of the liquid carrier in the electrostatic ink is typically 75 to 80 weight % when shipped to printers. The ink may be further diluted to about 98 weight % liquid content before it is used in a printing press.

The liquid carrier, particularly hydrocarbon liquid carriers, play an important role in achieving high offset-like print quality with the electrostatic printing presses. The liquid carrier is believed to swell, to some extent, the resin particles within the ink, and aid transfer to the PIP, then the intermediate transfer member, and finally to the print substrate, e.g. paper. The ink on the print substrates may contain less than 5 weight % oil, with the rest of the oil having been excluded from the ink in a number of previous stages in the printing process.

There is a belief in the art that concentrating liquid electrostatic inks to a solids content of 30-35 wt % or higher irreversibly changes the particle structures in the ink, degrading the print quality and making the ink unsuitable for use on the electrostatic printing presses.

WO 2011/001199, which is incorporated herein by reference in its entirety, describes ways of concentrating electrostatic inks that avoid degrading the ink quality. This document describes a preferred method of concentrating an ink using centrifugal force. Example 1 of this document describes using a centrifugal separator to concentrate an ink containing about 22 weight percent solids to an clumps of agglomerated particles that had a solids content of 47 weight percent. In Example 2, the product from Example 1 was allowed to stand in air for 25 to 50 hours to allow the liquid carrier to evaporate. The solids content of the product after this period was 60 wt %.

While the method described in WO2011/001199 goes some way to providing a way of concentrating inks without adversely affecting their quality, further improvements could be made.

DETAILED DESCRIPTION

Before the present invention is disclosed and described, it is to be understood that this invention is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

It is noted that, as used in this specification and the appended claims, the singular forms "a," "an," and "the" include plural referents unless the context clearly dictates otherwise.

As used herein, "liquid carrier", "carrier liquid," "carrier," or "carrier vehicle" refers to the fluid in which the polymers, particles, colorant, charge directors and other additives can be dispersed to form a liquid electrostatic ink or electrophotographic ink. Such carrier liquids and vehicle components are known in the art. Typical carrier liquids can include a mixture of a variety of different agents, such as surfactants, co-solvents, viscosity modifiers, and/or other possible ingredients.

As used herein, "electrostatic ink composition" generally refers to a ink composition in liquid form that is typically suitable for use in an electrostatic printing process, sometimes termed an electrophotographic printing process.

As used herein, "pigment" generally includes pigment colorants, magnetic particles, aluminas, silicas, and/or other ceramics or organo-metallics, whether or not such particulates impart color. Thus, though the present description primarily exemplifies the use of pigment colorants, the term "pigment" can be used more generally to describe not only pigment colorants, but other pigments such as organometallics, ferrites, ceramics, etc.

As used herein, "copolymer" refers to a polymer that is polymerized from at least two monomers.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly or indirectly via an intermediate transfer member. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involves subjecting the electrostatic ink composition to an electric field, e.g. an electric field having a field gradient of 1000 V/cm or more, optionally 1500 V/cm or more.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

Unless otherwise stated, any optional or preferred feature can be combined with any aspect of the invention or any other optional or preferred feature.

Figure 1:
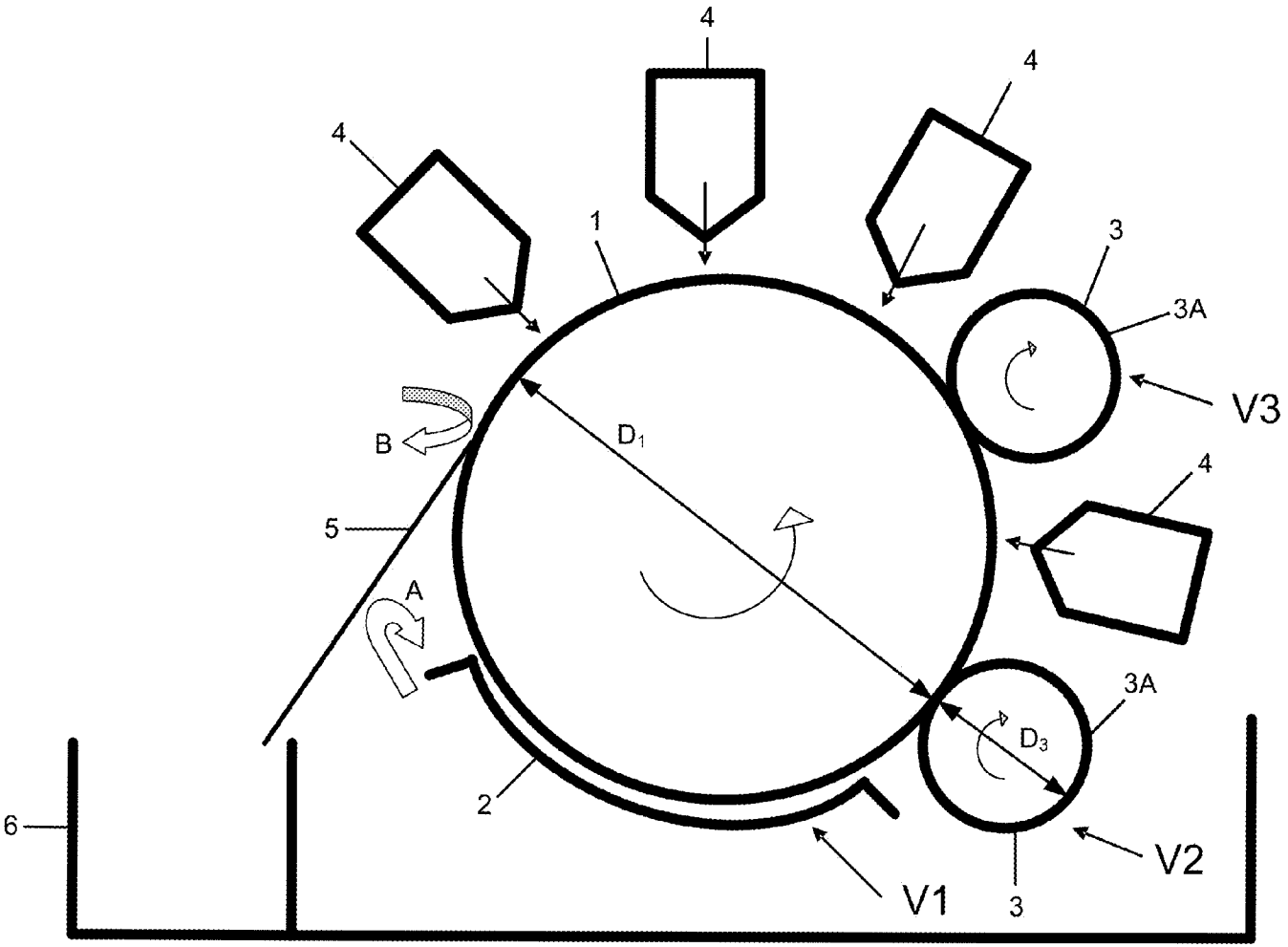
FIG. 1 illustrates schematically an embodiment of the apparatus on which the method of the present invention can be carrier out.

The present inventors provide, in a first aspect, a method for concentrating an ink for an electrostatic printing process, wherein the method comprises the steps of:

(a) providing the ink for an electrostatic printing process, the ink comprising chargeable particles in a liquid carrier;

(b) passing the ink between a chargeable conveyor and a first electrode, wherein a potential is applied such that the ink becomes adhered to the chargeable conveyor;

(c) passing the ink on the conveyor past a moving surface, wherein the ink contacts the moving surface and a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated ink on the conveyor, the conveyor and the moving surface then diverging from one another, such that substantially all of the concentrated ink remains on the conveyor;

(d) removing the concentrated ink from the conveyor and transferring it to a storage vessel.

The present inventors provide, in a second aspect, an apparatus for concentrating an ink for an electrostatic printing process, the apparatus comprising a chargeable conveyor, a first electrode, a moving surface, a concentrated ink removal means and a storage means, the apparatus configured to carry out a method comprising the step of:

a) passing an ink for an electrostatic printing process between the chargeable conveyor and the first electrode, wherein the ink comprises chargeable particles in a liquid carrier, and a potential is applied such that the ink becomes adhered to the chargeable conveyor;

b) passing the ink on the conveyor past the moving surface, wherein the ink contacts the moving surface and a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated ink on the conveyor, the conveyor and the moving surface then diverging from one another, such that substantially all of the concentrated ink remains on the conveyor;

c) removing the concentrated ink from the conveyor by the ink removal means and transferring it to the storage vessel.

The present inventors found that embodiments of the method and apparatus of the present invention can be used to produce concentrated electrostatic inks continuously. This is much more efficient that producing them in a batch process. Additionally, embodiments of the method and apparatus of the present invention can be used to concentrate inks with a starting solids content of a few weight percent to 40 weight percent or higher. The invention also avoids the need to use a centrifuge, some of which can have large footprints and be costly apparatus to purchase.

Ink for an Electrostatic Printing Process

The ink for the electrostatic printing process comprises chargeable particles in a liquid carrier. The chargeable particles may comprise a resin and a colorant or pigment.

The resin preferably includes a thermoplastic polymer. In particular, the polymer of the resin may be selected from ethylene acrylic acid copolymers; methacrylic acid copolymers; ethylene vinyl acetate copolymers; copolymers of ethylene (e.g. 80 wt % to 99.9 wt %) and alkyl (e.g. C1 to C5) ester of methacrylic or acrylic acid (e.g. 0.1 wt % to 20 wt %);

copolymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g. copolymer of acrylic or methacrylic acid and at least one alkyl ester of acrylic or methacrylic acid wherein alkyl is optionally from 1 to about 20 carbon atoms, such as methyl methacrylate (e.g. 50 wt % to 90 wt %)/methacrylic acid (e.g. 0 wt % to 20 wt %)/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

Generally, the liquid carrier acts as a dispersing medium for the other components in the ink. For example, the liquid carrier can comprise or be a hydrocarbon, silicone oil, vegetable oil, etc. The liquid carrier can include, but is not limited to, an insulating, non-polar, non-aqueous liquid that is used as the medium for toner particles. The liquid carrier can include compounds that have a resistivity in excess of about $10^9$ ohm-cm. The liquid carrier may have a dielectric constant below about 30, optionally below about 10, optionally below about 5, optionally below about 3. The liquid carrier can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Embodiments of the liquid carriers include, but are not limited to, aliphatic hydrocarbons, isoparaffinic compounds, paraffinic compounds, dearomatized hydrocarbon compounds, and the like. In particular, the liquid carriers can include, but are not limited to, Isopar-G™, Isopar-H™, Isopar-L™, Isopar-MT™, Isopar-K™, Isopar-V™, Norpar 12™, Norpar 13™, Norpar IS™, Exxol D40™ Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™). The liquid carriers and other components of the present disclosure are described in U.S. Pat. Nos. 6,337,168, 6,070,042, and 5,192,638, all of which are incorporated herein by reference.

In an embodiment, the liquid carrier, in step (a), constitutes about 20 to 99.5% by weight of the ink, optionally 50 to 99.5% by weight of the ink. In another embodiment, the liquid carrier, in step (a), constitutes about 40 to 90% by weight of the ink. In another embodiment, in step (a), the liquid carrier constitutes about 60 to 80% by weight of the ink composition. In another embodiment, in step (a), the liquid carrier may constitute about 90 to 99.5% of the electrostatic ink composition, optionally 95 to 99% of the electrostatic ink composition.

The ink for the electrostatic printing process may comprise a pigment. The chargeable particles may comprise a pigment. The pigments can be any pigment compatible with the liquid carrier and useful for electrostatic printing. For example, the pigment may be present as pigment particles, or may comprise a resin (in addition to the polymers described herein) and a pigment. The resins and pigments can be any of those commonly used as known in the art. For example, pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YELLOW H4G, HOSTAPERM® YELLOW H3G, HOSTAPERM® ORANGE GR, HOSTAPERM® SCARLET GO, Permanent Rubine F6B; pigments by Sun Chemical including L74-1357 Yellow, L75-1331 Yellow, L75-2337 Yellow; pigments by Heubach including DALAMAR® YELLOW YT-858-D; pigments by Ciba-Geigy including CROMOPHTHAL® YELLOW 3 G, CROMOPHTHAL® YELLOW GR, CROMOPHTHAL® YELLOW 8 G, IRGAZINE® YELLOW 5GT, IRGALITE® RUBINE 4BL, MONASTRAL® MAGENTA, MONASTRAL® SCARLET, MONASTRAL® VIOLET, MONASTRAL® RED, MONASTRAL® VIOLET; pigments by BASF including LUMOGEN® LIGHT YELLOW, PALIOGEN® ORANGE, HELIOGEN® BLUE L 690 IF, HELIOGEN® BLUE TBD 7010, HELIOGEN® BLUE K 7090, HELIOGEN® BLUE L 710 IF, HELIOGEN® BLUE L 6470, HELIOGEN® GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL® L; pigments by DuPont including TIPURE® R-101; and pigments by Paul Uhlich including UHLICH® BK 8200.

The ink for the electrostatic printing process may include a charge director. A charge director is added to the liquid carrier in order to maintain sufficient electrostatic charge on the ink particles. For example, the charge director can include nanoparticles of a simple salt and a sulfosuccinate salt of the general formula $MA_n$, wherein M is a metal, n is the valence of M, and A is an ion of the general formula $[R_1—O—C(O)CH_2CH(SO_3^-)OC(O)—O—R_2]$, where each of $R_1$ and $R_2$ is an alkyl group, or other charge component as found in WO2007130069, which is incorporated herein by reference in its entirety. Additionally, charge director compounds include ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director used herein can be any as known in the art such as described in U.S. Pat. No. 5,346,796, which is incorporated herein by reference in its entirety.

The electrostatic ink composition may comprise one or more additives, for example a charge adjuvant, a wax, a surfactant, biocides, organic solvents, viscosity modifiers, materials for pH adjustment, sequestering agents, preservatives, compatibility additives, emulsifiers and the like.

Chargeable Conveyor

The chargeable conveyor may be any suitable conveyor that can support and move the ink for the electrostatic printing process, and to which a potential can be applied. When charged, i.e. when a potential is applied between the chargeable conveyor and the electrode, the conveyor is adapted so that the chargeable particles adhere to the conveyor.

The conveyor will typically have a continuous surface that forms a loop. In an embodiment, the conveyor is in the form of rotatable drum, the outer surface of which acts to support the ink for the electrostatic printing process. The drum may rotate on an axis, which may be orientated at any desired angle. In an embodiment, the axis of the drum is on the horizontal. The drum may be any suitable shape, but is preferably cylindrical, with the axis of rotation forming the axis of the cylinder.

In an alternative embodiment, the chargeable conveyor is in the form of a belt that is driven by a suitable mechanism, such as one or more rollers.

The chargeable conveyor may comprise a metal. The metal may be selected from, but is not limited to, steel, aluminium and copper, and alloys including any of these metals. The chargeable conveyor may comprise a metal substrate, e.g a drum, having a surface covering of a non-metallic material, which may be a non-metallic, elastomeric or non-elastomeric material. Non-metallic, non-elastic materials may be selected from metal oxides and carbon-containing coatings, such as a diamond-like carbon coating. The elastomeric material may comprise a material selected from chloroprene rubber, isoprene rubber, EPDM rubber, polyurethane rubber, epoxy rubber, butyl rubber, fluoroelastomers (such as the commercially available Viton) and polyurethane. The elastomeric material may further comprise a resistivity control agent, which may be dispersed in the elastomeric material, and the resistivity control agent may be selected from an ionic material, a metal or carbon. The ionic material may be a quaternary ammonium compound. The resistivity control agent, which may be dispersed in the elastomeric material, may be selected from organic dyes, organic pigments, organic salts, polyelectrolytes, inorganic salts, plasticisers, inorganic pigments, metallic particles, charge transfer complexes or materials which produce charge transfer complexes with the elastomeric material, e.g. polyurethane. The resistivity control agent may be present in an amount of 0.1 to 6 wt % of the surface covering, with optionally the remaining wt percentage being the elastomeric material. The resistivity control agent is preferably a quaternary ammonium compound, for example a compound of the formula (NR1'R2'R3'R4)X', in which $R^{1'}$ $R^{2'}$ $R^{3'}$ and $R^4$ are each independently hydrocarbon groups, including, but not limited to, alkyl or aryl groups, and wherein the alkyl is substituted or unsubstituted, branched or straight-chain, saturated or unsaturated, and X' is an anion, such as a halide. Examples of quaternary ammonium compounds include, but are not limited to, tetraheptyl ammonium bromide, trimethyloctadecylammonium chloride, benzyltrimethylammonium chloride. In an embodiment, the resistivity control agent is a lithium salt.

The chargeable conveyor preferably comprises a metal substrate, e.g a drum, having a surface covering of a metal oxide, optionally the metal of the metal substrate and that of the metal oxide being the same. The surface covering may have a thickness of at least 5 μm, preferably at least 10 μm, preferably at least 15 μm, more preferably, at least 25 μm. In an embodiment, the surface covering may have a thickness of from 5 μm to 100 μm, optionally from 20 to 80 μm, optionally from 30 to 70 μm, optionally from 45 to 60 μm. In an embodiment, the chargeable conveyor comprises a metal substrate having an anodised surface coating of a metal oxide, optionally having a thickness of at least 5 μm, preferably at least 10 μm, preferably at least 15 μm, more preferably, at least 25 μm. In an embodiment, the chargeable conveyor comprises a metal substrate having an anodised surface coating of a metal oxide having a thickness of from 5 μm to 100 μm, optionally from 20 to 80 μm, optionally from 30 to 70 μm, optionally from 45 to 60 μm. In an embodiment, the chargeable conveyor comprises an aluminium substrate having an anodised surface coating comprising an aluminium oxide. The anodised surface coating is preferably a Type III anodised coating, sometimes termed in the art as an anodised hardcoat, a coating formed by hard anodising or by engineering anodising. Methods for carrying out Type III or hard anodising are known in the art, and standards for such anodising can be found, for example, in MIL-A-8625 Type III, AMS 2469H, BS ISO 10074:2010 and BS EN 2536:1995, the specifications of which are all incorporated herein by reference in their entirety. The present inventors have found that hard anodizing a surface of the metal chargeable conveyor produces a conveyor with a favourable resistivity that is able to suitably control charge transfer from the conveyor to the particles of the electrostatic ink composition.

The chargeable conveyor may be of any suitable size. In an embodiment, the chargeable conveyor has a width, measured in a direction across its surface perpendicular to the direction of movement of its surface of at least 40 cm, optionally at least 50 cm, optionally at least 60 cm, optionally at least 70 cm, optionally at least 1 m, optionally from 40 cm to 2 m, optionally from 50 cm to 150 cm. In an embodiment, the chargeable conveyor is or comprises a rotatable drum in the form of a cylinder that has a width, measured in a direction across its surface perpendicular to the direction of movement of its surface (i.e. parallel to the axis of the cylinder) of at least 40 cm, optionally at least 50 cm, optionally at least 60 cm, optionally at least 70 cm, optionally at least 1 m, optionally from 40 cm to 2 m, optionally from 50 cm to 150 cm. In an embodiment, the chargeable conveyor is or comprises a rotatable drum in the form of a cylinder that has a diameter, of at least 40 cm, optionally at least 50 cm, optionally at least 60 cm, optionally at least 70 cm, optionally at least 1 m, optionally from 40 cm to 2 m, optionally from 50 cm to 150 cm. In an embodiment, the ratio of width of the cylinder:diameter of cylinder is 2:1 to 1:2.

The chargeable conveyor preferably has a surface with a resistivity of about $1\times10^9$ to $1\times10^{11}$ Ohm*cm, preferably a resistivity of about $1\times10^{10}$ Ohm*cm.

First Electrode

The first electrode can be any suitable electrode capable of applying a potential between the chargeable conveyor and the first electrode. The electrode may be stationary relative to the chargeable conveyor. The first electrode may have a shape that, at least in part, corresponds to the shape of at least part of the chargeable conveyor. For example, if the chargeable conveyor is a cylinder having an axis, the electrode may have a cross section that forms part of a circle, the centre of this circle being the same as that for the cylinder. In an embodiment, if the chargeable conveyor is a cylinder having an axis, the electrode may have an inner surface that forms part of a cylinder shape, the axis of this cylinder shape being the same as that for the cylinder of the chargeable conveyor.

In an alternative embodiment, the first electrode may be in the form of roller or a belt, having a surface that can move in the same direction as the surface of the chargeable conveyor.

The electrode may comprise any electrically conducting material, including, but not limited to, a metal and carbon. The electrode may comprise a metal selected from copper, aluminium and steel.

The shortest distance between the first electrode and the chargeable conveyor is preferably from 0.5 mm to 5 mm, optionally from 0.5 to 2 mm, optionally from 0.8 mm to 1.2 mm.

In the method of the first aspect, a potential is applied such that the ink becomes adhered to the chargeable conveyor. The potential is preferably 500 V or more, optionally 1000 V or more, preferably 2000 V or more, preferably 3000 V or more.

The potential may be from 500 V to 7000V, optionally 1000 V to 7000 V, optionally 3000 V to 6000 V.

In the method, the surface of the conveyor may travel at a speed of from 1 to 100 cm/sec, preferably 5 to 50 cm/sec, preferably 10 to 30 cm/sec.

The gradient of the potential between the closest point between the chargeable conveyor and the first electrode may be from about $1\times10^4$ V/m to about $1\times10^7$ V/m, optionally about $1\times10^5$ V/m to about $1\times10^6$ V/m, optionally from about $2\times10^5$ V/m to $8\times10^5$ V/m, optionally from about $3\times10^5$ V/m to $6\times10^5$ V/m. The gradient potential is calculated by determining the voltage applied between the chargeable conveyor and the first electrode, and dividing this voltage between the chargeable conveyor and the first electrode at their closest point.

The first electrode may be positioned below the chargeable conveyor, with a separation between the first electrode and chargeable conveyor forming a gap. The method may be such that the ink for the electrostatic printing process fills, at least partially, the gap between the chargeable conveyor and the first electrode, and the potential in step (b) is applied such that the ink becomes adhered to the chargeable conveyor.

Moving Surface

The method involves passing the ink on the conveyor past the moving surface, wherein the ink contacts the moving surface and a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated ink on the conveyor.

The moving surface forms the outer surface of a moving body, which may be in the form of a drum or belt, as described herein. The moving surface may form part of a drum or a belt, driven by rollers. The moving surface and the body of which it forms part are able to be biased, such that a potential can be applied between the moving surface and the chargeable conveyor. The moving surface may be considered to be part of a second electrode.

In an embodiment, the moving surface forms the outer surface of a rotatable drum. The drum having the moving surface may rotate on an axis, which may be orientated at any desired angle. In an embodiment, the axis of the drum having the moving the surface is on the horizontal. The drum having the moving surface may be any suitable shape, but is preferably cylindrical, with the axis of rotation forming the axis of the cylinder.

In an alternative embodiment, the moving surface forms the outer surface of a belt that is driven by a suitable mechanism, such as one or more rollers.

The moving body having the moving surface may comprise a metal. In an embodiment, the moving body having the moving surface may comprise a metal having a surface covering comprising an elastomeric material. For example, the moving body having the moving surface may comprise a drum having a metal core with an outer surface layer comprising an elastomeric material. The metal may be selected from, but is not limited to, steel, aluminium and copper. The surface covering or outer surface layer may comprise an elastomeric material and a resistivity control agent, which may be dispersed in the elastomeric material. The resistivity control agent may act to increase or decrease the resistivity of the elastomeric material (compared to the same material absent said resistivity control agent). The elastomeric material may comprise a material selected from chloroprene rubber, isoprene rubber, EPDM rubber, polyurethane rubber, epoxy rubber, butyl rubber, fluoroelastomers (such as the commercially available Viton) and polyurethane.

The resistivity control agent, which may be dispersed in the elastomeric material, may be selected from an ionic material, a metal or carbon. The ionic material may be a quaternary ammonium compound. The resistivity control agent, which may be dispersed in the elastomeric material, may be selected from organic dyes, organic pigments, organic salts, polyelectrolytes, inorganic salts, plasticisers, inorganic pigments, metallic particles, charge transfer complexes or materials which produce charge transfer complexes with the elastomeric material, e.g. polyurethane. The resistivity control agent may be present in an amount of 0.1 to 6 wt % of the surface covering, with optionally the remaining wt percentage being the elastomeric material. The resistivity control agent is preferably a quaternary ammonium compound, for example a compound of the formula (NR1'R2'R3'R4)X', in which $R^{1'}$ $R^{2'}$ $R^{3'}$ and $R^4$ are each independently hydrocarbon groups, including, but not limited to, alkyl or aryl groups, and wherein the alkyl is substituted or unsubstituted, branched or straight-chain, saturated or unsaturated, and X' is an anion, such as a halide. Examples of quaternary ammonium compounds include, but are not limited to, tetraheptyl ammonium bromide, trimethyloctadecylammonium chloride, benzyltrimethylammonium chloride. In an embodiment, the resistivity control agent is a lithium salt.

If the moving surface is a moving body comprising a drum having a metal core with an outer surface layer comprising an elastomeric material, the resistivity of the surface of the drum is preferably from $1\times10^5$ Ohm*m to $1\times10^8$ Ohm*m, optionally $1\times10^6$ Ohm*m to $1\times10^7$ Ohm*m, when measured between the roller and a metal rod in contact, the total area of the contact along the roller of about 340 mm is about 1 cm.

In an embodiment the chargeable conveyor comprises a metal substrate, e.g. a drum, having a surface covering of a non-metallic, elastomeric material, and the moving body having the moving surface comprises a metal substrate, e.g. a drum, having a surface covering of a non-metallic, non-elastomeric material. In a preferred embodiment, the chargeable conveyor comprises a metal substrate, e.g a drum, having a surface covering of a non-metallic, non-elastomeric material, and the moving body having the moving surface comprises a metal substrate, e.g. a drum, having a surface covering of a non-metallic material, which may be a non-metallic, elastomeric material.

In an embodiment, a plurality of moving surfaces are disposed around the chargeable conveyor. For example, the first conveyor may comprises a first drum, and a plurality of second drums having the moving surface are disposed around the first drum. For example, the first conveyor may comprise a first drum, and at least two, optionally at least three, optionally at least four second drums having the moving surface are disposed around the first drum. The surface covering preferably has a resistivity of from 107 to 1011 ohm cm. The surface covering on the moving surface may have a thickness of from 0.001 mm to 20 mm, optionally 0.05 mm to 10 mm, optionally from 1 mm to 10 mm, optionally 1 mm to 3 mm, optionally 3 mm to 8 mm. The moving body having the moving surface may be constructed as described in the U.S. Pat. No. 3,863,603 (see description of the magnetic brush roll) and U.S. Pat. No. 3,959,574 (see description of the biasable transfer member), both of which are incorporated herein by reference in their entirety.

Preferably, the surface of the chargeable conveyor and the moving surface travel at the same relative speed and in the same direction at the point where they are closest to one another. In the method, the surface of the conveyor and the moving surface may travel at a speed of from 1 to 100 cm/sec, preferably 5 to 50 cm/sec, preferably 10 to 30 cm/sec.

In the method, a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated ink on the conveyor. The potential applied between the conveyor and the moving surface may be less than that applied between the electrode and the chargeable conveyor. The potential applied between the conveyor and the moving surface may be in the range of from 300 to 4000 V, optionally 300 to 2000V, optionally 300 to 1500 V, optionally 500 to 1200 V, optionally from 600 to 1100 V, optionally from 700 to 1000 V, optionally from 800 to 900 V.

In the method, after the concentrated ink has been formed on the chargeable conveyor, the conveyor and the moving surface then diverge from one another, such that substantially all of the concentrated ink remains on the conveyor. In an embodiment, "substantially all of the concentrated ink" indicates that at least 90 wt %, optionally at least 95 wt %, optionally at least 99 wt %, of the particles in the concentrated ink remain adhered to the chargeable conveyor. Preferably only a very small quantity, optionally none, of the concentrated ink is transferred to the moving surface. In an embodiment, "a very small quantity", indicates that 10 wt % or less, optionally 5 wt %, optionally 1 wt % or less of the particles in the concentrated ink are transferred to the moving surface.

Preferably, neither the chargeable conveyor nor the moving surface is or is part of a photoimaging plate.

Stream of Gas

The method may further involve directing one or more streams of gas, e.g. air, at the electrostatic ink on the chargeable conveyor. A stream of gas may be directed at the electrostatic ink on the chargeable conveyor before, during and/or after it has contacted the moving surface. Accordingly, the stream of gas may be directed at the electrostatic ink on the chargeable conveyor before or after it has been concentrated or during the concentration step involving the moving surface. In an embodiment, a stream of gas is directed at the electrostatic ink on the chargeable conveyor 0 to 30° from an angle that is perpendicular to the surface of the chargeable conveyor on which the electrostatic ink is disposed. In an embodiment, a stream of gas is directed at the electrostatic ink on the chargeable conveyor 0 to 20°, optionally 0 to 10°, 0 to 5°, optionally about 0° from an angle that is perpendicular to the surface of the chargeable conveyor on which the electrostatic ink is disposed. For example, if the chargeable conveyor comprises a drum in the form of a cylinder, during the method, the stream of gas may be directed toward the cylinder at an angle 0 to 30° from the radius of the cylinder.

In an embodiment, the one or more streams of gas may be produced by one or more air knives. Air knives are known to the skilled person.

The one or more streams of gas, e.g. air, may have a moving gas speed of at least 50 m/s, optionally at least 80 m/s, optionally at least 100 m/s. The one or more streams of gas, e.g. air, may have a moving gas speed of from 50 to 200 m/s, optionally 80 to 150 m/s, optionally from 100 to 120 m/s.

The one or more streams of gas preferably has a temperature of less than 60° C., optionally less than 50° C., optionally less than 40° C., optionally less than 30° C. The one or more streams of gas preferably has a temperature of from 10° C. to 60° C., optionally a temperature of from 15° C. to 50° C., optionally a temperature of from 20° C. to 40° C., optionally a temperature of from 20° C. to 30° C.

The stream of gas has been found to further concentrate the ink, without significantly affecting the integrity of the resin particles.

Removing the Concentrated Ink

The method involves removing the concentrated ink from the conveyor and transferring it to a storage vessel. The removal is preferably by scraping the ink from the surface of the chargeable conveyor. The scraping may be effected by placing a stationary member, e.g. a plate or blade, in close proximity to, optionally in contact with, the surface of the chargeable conveyor. The plate or blade preferably extend across the whole width of the chargeable conveyor, said width typically being perpendicular to the direction of travel of the surface of the chargeable conveyor. The stationary member may comprise any suitable material, including, but not limited to a metal or plastic.

The storage vessel may be any suitable container for an ink for an electrostatic printing process. In an embodiment, the ink is transferred to a storage container, which is then sealed. The sealed storage container containing the ink for the electrostatic printing process can then be transported as desired, for example to another site, where printing may take place.

Optionally, the method may further involve, after producing the concentrated ink and transferring it to a storage vessel, optionally transporting the ink to another site, then diluting it with a carrier medium to reduce the solids content in weight percent (for example from a solids content of 30 wt % or more, optionally 40 wt % or more, to a solids content of 10 wt % or less, optionally 5 wt % or less), and then using the ink in an electrostatic printing process.

The concentrated ink, at the end of step (c) of the process may comprise 30% by weight or more solids, optionally 35% by weight or more solids, optionally 40% by weight or more solids.

The electrostatic printing process may involve providing the concentrated ink, optionally diluting it with a carrier medium to reduce the solids content in weight percent (for example from a solids content of 30 wt % or more, optionally 40 wt % or more, to a solids content of 10 wt % or less, optionally 5 wt % or less):

forming a latent electrostatic image on a surface;

contacting the surface with the ink, such that at least some of the particles adhere to the surface to form a developed toner image on the surface, and transferring the toner image to a print substrate.

The surface on which the latent electrostatic image is formed may be on a rotating member, e.g. in the form of a cylinder. The surface on which the latent electrostatic image is formed may form part of a photo imaging plate (PIP). The contacting may involve passing the electrostatic composition of the first aspect between a stationary electrode and a rotating member, which may be a member having the surface having a latent electrostatic image thereon or a member in contact with the surface having a latent electrostatic image thereon. A voltage is applied between the stationary electrode and the rotating member, such that the particles adhere to the surface of the rotating member. This may involve subjecting the electrostatic ink composition to an electric field having a field gradient of 1000 V/cm or more, optionally 1500 V/cm or more.

The intermediate transfer member may be a rotating flexible member, which is optionally heated, e.g. to a temperature of from 80 to 160° C. The print substrate may be any suitable substrate. The substrate may be any suitable substrate capable of having an image printed thereon. The substrate may comprise a material selected from an organic or inorganic material. The material may comprise a natural polymeric material, e.g. cellulose. The material may comprise a synthetic polymeric material, e.g. a polymer formed from alkylene monomers, including, but not limited to, polyethylene and polypropylene, and co-polymers such as styrene-polybutadiene. The polypropylene may optionally be biaxially orientated polypropylene. The material may comprise a metal, which may be in sheet form. The metal may be selected from or made from, for instance, aluminum (Al), silver (Ag), tin (Sn), copper (Cu), mixtures thereof. In an embodiment, the print substrate comprises a cellulosic paper. In an embodiment, the cellulosic paper is coated with a polymeric material, e.g. a polymer formed from styrene-butadiene resin. Optionally, the cellulosic paper has an inorganic material bound to its surface (before printing with ink) with a polymeric material, wherein the inorganic material may be selected from, for example, kaolinite or calcium carbonate. The print substrate is optionally a cellulosic print substrate such as paper. The cellulosic print substrate is optionally a coated cellulosic print substrate, e.g. having a coating of a polymeric material thereon.

An embodiment of the apparatus and method of the present invention will now be described.

FIG. 1 shows schematically an apparatus for concentrating an ink for an electrostatic printing process. The apparatus comprises a chargeable conveyor in the form of a first drum 1, an electrode 2 in the form of a curved plate located below the drum 1, two second drums 3 having a surface 3A, a plurality of air knifes 4, a scraper 5, and a storage vessel 6.

The first drum 1 has a diameter $D^1$, and the second drums 3 each have a diameter $D^3$. The diameter $D^3$ is approximately the same as or smaller than diameter $D^1$.

As can be seen, the electrode 2 is in the form of a plate having a curvature that corresponds to shape of the first drum 1. The plate forms a curve that, if extended would form a cylinder having an axis that is coincident with the axis of the first drum 1. The first drum may be as described herein. In an embodiment, it has a core of metal, e.g. aluminium, and a surface coating of an anodized metal.

The surface of each of the second drums, in the absence of the ink for the electrostatic printing process, is in contact with the surface of the first drum. Each of the second drums has a core of a metal and a coating of an elastomeric material, e.g polyurethane, in which is optionally dispersed a resistivity control agent, such as a quaternary amine.

An air knife 4 is located between each of the second drums 3. Three further air knives 4 are located anti clockwise from the uppermost second drum 3. Each air knife is orientated such that a stream of air is directed toward the surface of the drum 1 along the radius of the cylinder of the drum. Optionally a further air knife may be located between the electrode 2 and the lowermost second drum 3, such that the ink on the chargeable conveyor, after leaving the gap between the electrode and chargeable conveyor, is subjected to a stream of gas (e.g. air) from this further air knife.

A scraper 5 in the form of a metal blade is biased against the first drum 1 by a biasing means, e.g. springs (not shown).

A storage vessel 6 is located below the metal blade 5.

In use, an ink for use in an electrostatic printing process is fed into the gap between the first drum 1 and the electrode 2, at a point shown by arrow A. A potential V1 is applied between the electrode 2 and the drum 1, such that the particles in the ink move toward and adhere to the surface of the drum 1, together with some of the carrier liquid in which they are dispersed, to form a layer of ink on the surface of the first drum 1. The first drum rotates anticlockwise, such that the ink moves toward a second drum 3. The second drum 3 rotates so the surface of the second drum 3 moves at the same speed as the surface of the first drum 1 at their point of contact. A potential V2 is applied between the first drum 1 and the second drum 3, such that the particles are drawn toward the first drum and away from the second drum. The second drum 3 contacts the ink on the surface of the first drum and acts to remove some of the liquid carrier from the ink, while much, if not all, of solids remains adhered to the surface of the first drum, together with the remaining liquid carrier. This produces a concentrated ink on the surface of the first drum.

The concentrated ink then passes the stream of air produced by the air knife, which serves to evaporate more of the liquid carrier, again further concentrating the ink on the surface of the first drum 1. The ink then moves toward and passes a further second drum 3. A potential V3 is applied between this further second drum 3 and the first drum 1, again such that the particles are drawn toward the surface of the first drum and away from the further second drum 3. More of the liquid carrier in the ink is removed, further concentrating the ink on the surface of the first drum.

The concentrated ink then passes three further streams of air from three further air knives, concentrating the ink further. The concentrated ink then reaches the blade 5, which is urged against the surface of the first drum 1 by means such as springs.

The blade acts to scrape off the concentrated ink from the surface of the first drum 1 (at arrow B). The blade is orientated so that the concentrated ink then slides downward toward a storage vessel 6.

The concentrated ink is then packaged and stored as required. It can be transported to another site, e.g. a site having apparatus for electrostatic printing, and then used for this electrostatic printing. It can be diluted if required by adding a liquid carrier, and then used in the electrostatic printing process.

EXAMPLES

The following examples illustrate a number of variations of the present compositions and methods that are presently known to the inventors. However, it is to be understood that the following are only exemplary or illustrative of the application of the principles of the present compositions and methods. Numerous modifications and alternative compositions and methods may be devised by those skilled in the art without departing from the spirit and scope of the present compositions and methods. The appended claims are intended to cover such modifications and arrangements. Thus, while the present methods and apparatus have been described above with particularity, the following examples provide further detail in connection with what are presently deemed to be acceptable.

The present inventors carried out an embodiment of the present method on a laboratory scale apparatus, much like the one shown in FIG. 1 and described above, although with certain differences, which will be described below. They used, as a first drum, an aluminum drum coated with hard anodize to create an optimum resistivity. The thickness of the hard anodise coating on the drum was 45 to 60 microns.

The aluminium drum is located in an upper part of a tank, which acts as a housing for all components of the apparatus. The dimensions of the first drum 1 are as follows:

Diameter—70 mm

Width—70 mm

The length of adjacent electrode 2 is 60 mm and it is distanced at 0.8-0.9 mm from the drum.

A conductive rubber squeegee roller, acting as the second drum 3, is in contact with the first drum 1 along all of its working width applying mechanical pressure and electrical bias. The conductive rubber squeegee roller had a metal core with 3 mm thick polyurethane coating, the polyurethane having been impregnated with an ammonium salt (Larostat, available from BASF). The second drum 3 was of approximately the same diameter as the first drum 1.

A metal blade 5 acts as a scraper and is pressed with springs to the drum after the squeegee roller to collect the concentrated material. In this embodiment, there was no further second drum, nor any air knives.

The process speed, i.e. the speed of the surface of the first drum, was 200 mm/sec during this test.

The potential between the electrode 2 and the first drum 1 was 3,000 V, with the electrode acting as the cathode and the drum acting as the anode. The potential between the second drum (the squeegee roller) and the first drum was 840 V.

The concentration of ink, in terms of total solids content in wt %, both before and after concentration, was measured using standard moisture analyzer Sartorius MA150.

The productivity of the device was measured by weigh of the amount of toner collected during predefined time from predefined width.

A commercially available electrostatic ink, cyan ElectroInk EI4.5, available from Hewlett Packard, was used for these tests; such an ink contains a natural (lecithin-containing) charge director, which imparts a negative charge on the resin particles. The ink as supplied had a solids content of 22 to 24 wt %. For these tests, the ink was first diluted to a desired solids content (generally a solids content of 11 wt % or less—see "Initial Concentration" in FIG. 2) by adding Isopar L liquid, available from Exxon Mobil. The ink having the desired solids content was then fed through the apparatus mentioned above.

Figure 2:
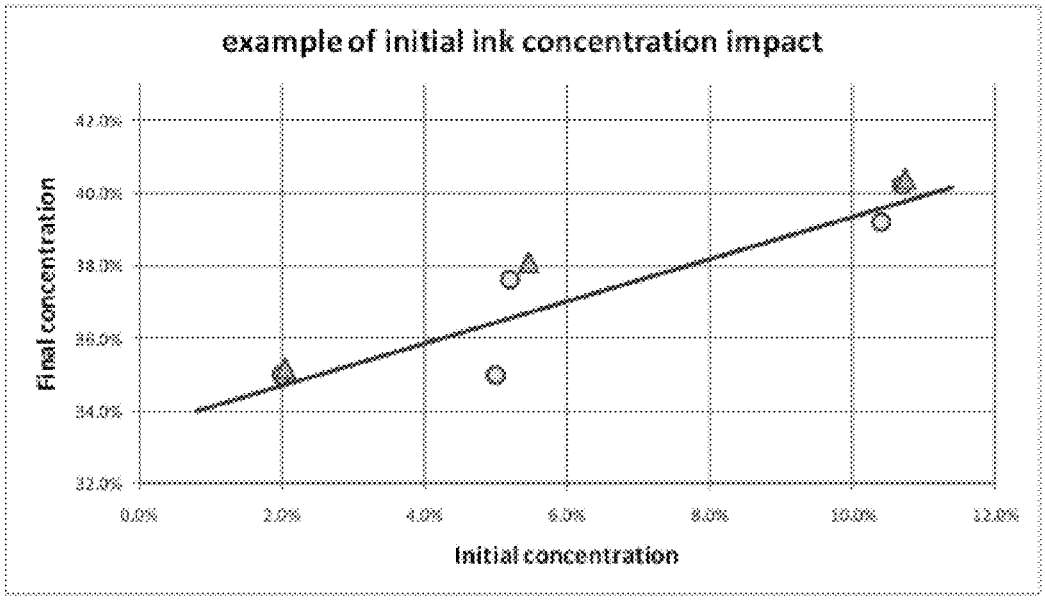
FIG. 2 illustrates a plot of the final concentration (total solids content in wt %) of an ink having been concentrated in an embodiment of the method of the present invention against the initial concentration (i.e. total solids content in wt %). This is described further in the Examples below.
Figure 3:
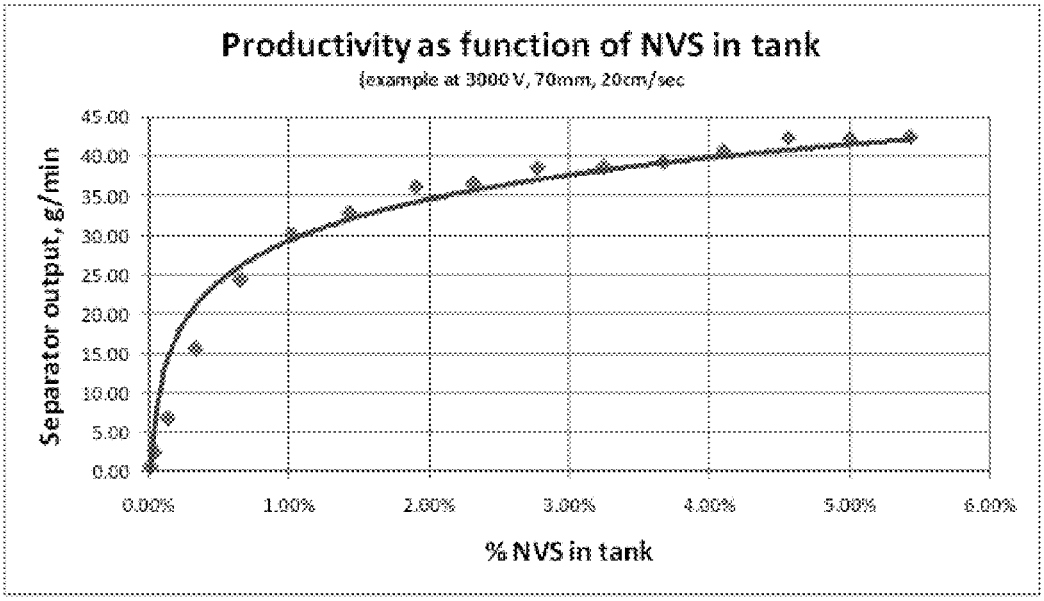
FIG. 3 illustrates a plot of the separator output (in g/min) against the wt % of non-volatile solids in the tank. This is described further in the Examples below.

The results of the test are shown in FIGS. 2 and 3. As can be seen, an apparatus having a single second drum was able to concentrate the ink from single-digit concentrations to concentrations above 30 wt % solids.

While the invention has been described with reference to certain embodiments, those skilled in the art will appreciate that various modifications, changes, omissions, and substitutions can be made without departing from the spirit of the disclosure. It is intended, therefore, that the invention be limited only by the scope of the following claims. Unless otherwise stated, the features of any dependent claim can be combined with the features of any of the other dependent claims.

The invention claimed is:

1. A method for concentrating an ink for an electrostatic printing process, wherein the method comprises the steps of:

(a) providing the ink for an electrostatic printing process, the ink comprising chargeable particles in a liquid carrier;

(b) passing the ink between a chargeable conveyor and a first electrode, wherein a potential is applied such that the ink becomes adhered to the chargeable conveyor;

(c) passing the ink on the conveyor past a moving surface, wherein the ink contacts the moving surface and a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated ink on the conveyor, the conveyor and the moving surface then diverging from one another, such that substantially all of the concentrated ink remains on the conveyor;

(d) removing the concentrated ink from the conveyor and transferring it to a storage vessel.

2. A method according to claim 1, wherein the chargeable conveyor is or comprises a rotatable drum in the form of cylinder.

3. A method according to claim 2, wherein the drum comprises a metal core having a surface covering of a non-metallic, elastomeric or non-elastomeric material.

4. A method according to claim 2, wherein the drum comprises an aluminium core, which has a Type III anodised surface covering.

5. A method according to claim 1, wherein the moving surface forms part of a moving body in the form of a rotatable drum.

6. A method according to claim 5, wherein the drum has a metal core with an outer surface layer comprising an elastomeric material.

7. A method according to claim 1, wherein the potential applied between the first electrode and chargeable conveyor is 500 V to 6000 V.

8. A method according to claim 1, wherein the gradient of the potential between the closest point between the chargeable conveyor and the first electrode is from 1×104 V/m to 1×107 V/m.

9. A method according to claim 1, wherein the potential applied between the conveyor and the moving surface is from 300 to 4000 V.

10. A method according to claim 1, wherein the method further involves directing one or more streams of gas at the electrostatic ink on the movable conveyor.

11. A method according to claim 1, wherein a stream of gas is directed at the electrostatic ink on the chargeable conveyor 0 to 30° from an angle that is perpendicular to the surface of the movable conveyor on which the electrostatic ink is disposed.

12. An apparatus for concentrating an ink for an electrostatic printing process, the apparatus comprising a chargeable conveyor, a first electrode, a moving surface, a concentrated ink removal means and a storage means, the apparatus configured to carry out a method comprising the step of:

a) passing an ink for an electrostatic printing process between the chargeable conveyor and the first electrode, wherein the ink comprises chargeable particles in a liquid carrier, and a potential is applied such that the ink becomes adhered to the chargeable conveyor;

b) passing the ink on the conveyor past the moving surface, wherein the ink contacts the moving surface and a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated ink on the conveyor, the conveyor and the moving surface then diverging from one another, such that substantially all of the concentrated ink remains on the conveyor;

c) removing the concentrated ink from the conveyor by the ink removal means and transferring it to the storage vessel.

13. An apparatus according to claim 12, wherein the chargeable conveyor is or comprises a rotatable first drum in the form of cylinder, the moving surface forms the surface of one or more rotatable second drums, each in the form of a cylinder.

14. An apparatus according to claim 13, wherein the first drum comprises an aluminium core, which has a Type III anodised surface covering, and the second drum has a metal core with an outer surface layer comprising an elastomeric material.

15. An apparatus according to claim 12, wherein the apparatus is adapted to apply a potential between electrode and chargeable conveyor of 500 V to 6000 V, and a potential between the conveyor and the moving surface of from 300 to 4000 V.

16. The method of claim 1, wherein neither the chargeable conveyor nor the moving surface is a photoimaging plate or a part of a photoimaging plate.

17. The apparatus of claim 12, wherein neither the chargeable conveyor nor the moving surface is a photoimaging plate or a part of a photoimaging plate.

* * * * *